US008043144B2

(12) United States Patent
Palushaj

(10) Patent No.: US 8,043,144 B2
(45) **Date of Patent: *Oct. 25, 2011**

(54) ABRASIVE PREPARATION DEVICE WITH AN IMPROVED ABRASION ELEMENT ASSEMBLY

(75) Inventor: Simon Palushaj, Washington, MI (US)

(73) Assignee: Epoxi Tech, Inc., Madison Heights, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/707,339

(22) Filed: Feb. 17, 2010

(65) Prior Publication Data

US 2010/0203814 A1 Aug. 12, 2010

Related U.S. Application Data

(63) Continuation of application No. 11/655,742, filed on Jan. 19, 2007, now Pat. No. 7,690,970.

(51) Int. Cl.
*B24B 23/00* (2006.01)

(52) U.S. Cl. ..... 451/353; 451/359

(58) Field of Classification Search ..... 451/353, 451/354, 359, 463, 464, 466, 468, 469, 490, 451/350, 360

See application file for complete search history.

(56) References Cited

U.S. PATENT DOCUMENTS

| | | | |
|---|---|---|---|
| 3,522,342 | A | 7/1970 | Nungesser et al. |
| 3,696,563 | A | 10/1972 | Rands |
| 3,871,139 | A | 3/1975 | Rands |
| 3,913,282 | A | 10/1975 | Whitsett |
| 4,037,369 | A | 7/1977 | Campbell |
| 4,490,872 | A | 1/1985 | Drumm |
| 4,493,126 | A | 1/1985 | Uy |
| 4,493,170 | A | 1/1985 | Hanger |
| 4,507,361 | A | 3/1985 | Twilley et al. |
| 4,561,214 | A | 12/1985 | Inoue |
| 4,614,380 | A | 9/1986 | Allen |
| 4,662,044 | A | 5/1987 | Kayabara |
| 5,050,262 | A | 9/1991 | Malish |
| 5,224,231 | A | 7/1993 | Nacar |
| 5,309,681 | A | 5/1994 | Cheney et al. |
| 5,323,505 | A | 6/1994 | Montabaur et al. |
| 5,438,728 | A | 8/1995 | Kubes et al. |
| 5,445,438 | A | 8/1995 | Drumm |
| 5,454,752 | A | 10/1995 | Sexton et al. |

(Continued)

FOREIGN PATENT DOCUMENTS

| | | | |
|---|---|---|---|
| GB | 1262020 | A | 2/1972 |

(Continued)

OTHER PUBLICATIONS

International Search Report PCTUS2008000752 Dated: Jun. 5, 2008.

(Continued)

*Primary Examiner* — Dung Van Nguyen
(74) *Attorney, Agent, or Firm* — Rader, Fishman & Grauer, PLLC

(57) ABSTRACT

Disclosed is an exemplary abrasive surface preparation device for use with a rotary device having a rotatable housing and a support member extending obliquely from the housing. The exemplary abrasive hard surface preparation device includes a substantially planar substrate layer having a first end connectable to the support member and an opposite second end. An abrasive material is attached to at least the second end of the substrate layer.

14 Claims, 4 Drawing Sheets

U.S. PATENT DOCUMENTS

| | | | | |
|---|---|---|---|---|
| 5,491,025 | A | 2/1996 | Pihl et al. | |
| 5,679,067 | A | 10/1997 | Johnson et al. | |
| 5,903,951 | A | 5/1999 | Ionta et al. | |
| 5,983,434 | A | 11/1999 | Eichinger et al. | |
| 6,123,612 | A | 9/2000 | Goers | |
| 6,126,533 | A | 10/2000 | Johnson et al. | |
| 6,249,928 | B1 | 6/2001 | Wang | |
| 6,251,002 | B1 | 6/2001 | Close | |
| 6,312,485 | B1 | 11/2001 | Kaiser et al. | |
| 6,352,471 | B1 | 3/2002 | Bange et al. | |
| 6,422,932 | B1 | 7/2002 | Lageson et al. | |
| 6,665,902 | B1 | 12/2003 | Vegter | |
| 6,669,746 | B2 | 12/2003 | Niizaki et al. | |
| 6,840,849 | B2 | 1/2005 | MacKay | |
| 6,893,335 | B2 | 5/2005 | MacKay | |
| 7,004,829 | B2 * | 2/2006 | Keuler | 451/466 |
| 7,081,047 | B2 | 7/2006 | Palushaj | |
| 7,144,194 | B2 * | 12/2006 | Kipp, Jr. | 404/112 |
| 7,357,705 | B2 | 4/2008 | Miyanaga | |
| 7,690,970 | B2 * | 4/2010 | Palushaj | 451/353 |
| 7,727,056 | B2 * | 6/2010 | Gilles | 451/465 |
| 2002/0094437 | A1 | 7/2002 | Niizaki et al. | |
| 2002/0148059 | A1 | 10/2002 | Lin | |
| 2002/0182983 | A1 | 12/2002 | Yamamoto et al. | |
| 2005/0260940 | A1 | 11/2005 | Palushaj | |
| 2006/0025059 | A1 | 2/2006 | Gueorguiev et al. | |

FOREIGN PATENT DOCUMENTS

| | | | |
|---|---|---|---|
| WO | WO-2005/113198 | A2 | 12/2005 |
| WO | WO-2008/088908 | A1 | 7/2008 |

OTHER PUBLICATIONS

International Search Report for PCT/US2009/056056 dated Dec. 22, 2009.

* cited by examiner

ABRASIVE PREPARATION DEVICE WITH AN IMPROVED ABRASION ELEMENT ASSEMBLY

CROSS REFERENCE TO RELATED APPLICATIONS

This application is a continuation of U.S. Ser. No. 11/655,742, filed on Jan. 19, 2007, now U.S. Pat. No. 7,690,970, issued on Apr. 6, 2010, which application is incorporated herein by reference in its entirety.

TECHNICAL FIELD

The field of this invention relates to a reinforced abrasive abrading and grinding device for sanding hard floors and surfaces, for example cement, stone or imitation stone.

BACKGROUND OF THE DISCLOSURE

While concrete or cement is a very popular material for use in floors and construction materials because of its strength, durability and low costs, if the concrete or cement is left unfinished, the concrete floor will inherently produce dust by the constant scuffing it undergoes whether by foot traffic or wheeled traffic and be susceptible to staining due to porosity.

One is thus faced with a dilemma of cleaning a concrete floor with its no gloss utilitarian appearance and with the disadvantage of the inevitable dust that emanates from an unfinished concrete floor or spending considerable money for a protective and decorative covering surface. Vast improvements in coatings for concrete floors have taken place in the recent past and one may also desire to remove an older worn or failed coating and replace it with one of the newer type coatings. Part of the expense to obtain a decorative and protective covering is due to the preparation of the concrete floor to accept the new covering surface. The preparation often includes aggressive sanding to rough up the concrete surface and to remove any previously applied top coating, oil, or grease stains to assure proper adhesion of the new covering. Aggressive sanding of the concrete surface with conventional sand paper on sanding machines is a time consuming effort requiring frequent replacement of the sand paper as the sand particles become worn.

Attempts for more aggressive sanding and grinding pads have incorporated hardened particles such as diamonds or silicon carbide. While these pads performed well when new, it has been found that only a small percentage of the particles actually touch the surface at a given time. The cutting edges of these few engaging particles become rounded out through wear and the sanding performance substantially diminishes. In the trade, this is sometimes referred to as a ball bearing effect because the few now rounded diamond particles glide over the surface and no longer effectively cut into the surface.

Other problems are known that also prevent or limit the application of hardened particles. The present application of an abrasive bristle made from today's known higher temperature plastic materials when combined with the aforementioned hard abrasive materials generate much heat when used on a high speed power sander. The generated heat is sufficient to melt the plastic material and fuses the abrasive bristles together rendering the bristle pad useless.

The high heat and slow grinding rates pose particular problems for preparation of concrete surfaces that have mastic or older plastic and paints previously coated thereon. The heat melts the old coating materials as it is removed and the coating then adheres to and gums up the bristles which then quickly lose most of their sanding and grinding effectiveness.

Previous attempts to produce metal bristles also encountered problems. Attempts have been made to provide hard particles such as silicon carbide or diamond secured onto a bristle strip, blade or plate. The hard particles may be diamond particles brazed onto spring steel or other metal substrate. If the metal substrate is fully brazed with particles, the substrate becomes too brittle and breaks off during high speed application. Even spring steel loses its resilient spring nature after it undergoes brazing. Attempts to limit the diamond particles only to the extreme ends or tips of the bristles to maintain the flexibility of the metal dramatically shorten the workable life of the bristle.

What is needed is an abrasive device for concrete sanding that has an improved performance profile by incorporating hardened particles only along a front face of a distal section of a substrate layer and which expose new particle edges as the substrate layer wears down. What is also needed is a flexible metal abrasive element with hardened particles secured thereon with the brazed section only on a front facing distal section of a substrate layer. What is also needed is a metal substrate layer with particles brazed thereon and further reinforced and supported by a resilient backing element to maintain sufficient flexibility and support of the metal substrate layer.

What is also needed is a durable abrasion element assembly for mounting to a cleaning or sanding machine that is suitable for preparing cement floors for coating. What is also needed is an expedient method to prepare a polished concrete floor to cut away plastic, mastic and the other heat sensitive materials by an aggressive cutting which forms enough concrete dust to coat the removed waste product before it can stick or adhere to the surfaces of the abrasion element assembly. What is also needed is an abrasion element assembly that has abrasive particles securely affixed to a substrate layer that is reinforced and supported by a resilient backing layer. What is also needed is an efficient sanding element that can be used with decreased horsepower most commonly available on consumer oriented sanding and cleaning machines.

SUMMARY OF THE DISCLOSURE

In accordance with one aspect of the invention, an abrasive surface preparation device for hard surfaces has a housing, for example a rotatable pad that rotates about its center, for moving over a hard work surface, for example cement, stone, tile or synthetic materials. The housing has a plurality of downwardly extending abrasive elements having a forward facing respective abrasive face with a width and length. Each abrasive element has a substrate layer and an abrasive material secured to the front surface of the substrate layer. Each substrate layer is reinforced by a backing element. The backing element is affixed to the housing such that the forward facing abrasive face generally faces the normal direction of motion of the housing. In another embodiment, the substrate layer is adhered to the backing element with an adhesive bond.

Preferably, the substrate layer and the backing element depend downwardly from the housing and are canted between 5° and 75° and most desirably between 25° to 60° from the perpendicular such that the distal lower ends of the substrate layer and backing element are positioned rearwardly of the proximate mounted section at the housing during normal motion of the housing. The abrasive material faces generally forward toward the motion of the housing.

It is also desirable that the substrate layer and the backing element are in abutting relationship with each other and both are affixed to a mounting bracket. The mounting bracket in turn is affixed to the housing.

Preferably, the abrasive elements are circumferentially spaced on the rotatable pad in proximity to its periphery. In one embodiment, the abrasive elements have their respective front abrasive faces substantially radially aligned with the rotational center of the rotatable pad.

The abrasive material is desirable diamond particles. The diamond particles may have varying sizes between 3.4 millimeters diameter and 0.5 microns, i.e., between 5 mesh and 120 mesh. The abrasive particles are desirably secured via brazing with a brazing material on a distal section of the front surface of the substrate layer. The proximate front section and rear surface of the substrate layer are substantially devoid of the brazing material and diamond particles. The substrate layer is preferably made from a low carbon steel and the backing element is preferably made from a spring steel.

According to another aspect of the invention, an abrasive element assembly has a substrate layer with abrasive particles brazed with brazing material to a distal front section thereof A backing element is affixed against and provides flex support and reinforcement for the substrate layer. A supporting bracket is affixed to the backing plate. The supporting bracket is constructed for being mounted to a movable housing of a powered abrading device for example a sander or cleaning machine.

The abrasive element assembly preferably has the upper section of the mounting bracket constructed for mounting to the housing and an incline depending section for mounting the backing plate and the substrate layer at an angle from a perpendicular. It is desirable that abrasive material made from diamond particles is secured with a brazing material only at a front distal section of the substrate layer.

BRIEF DESCRIPTION OF THE DRAWINGS

Reference now is made to the accompanying drawings in which.

DETAILED DESCRIPTION OF THE PREFERRED EMBODIMENT

Figure 1:
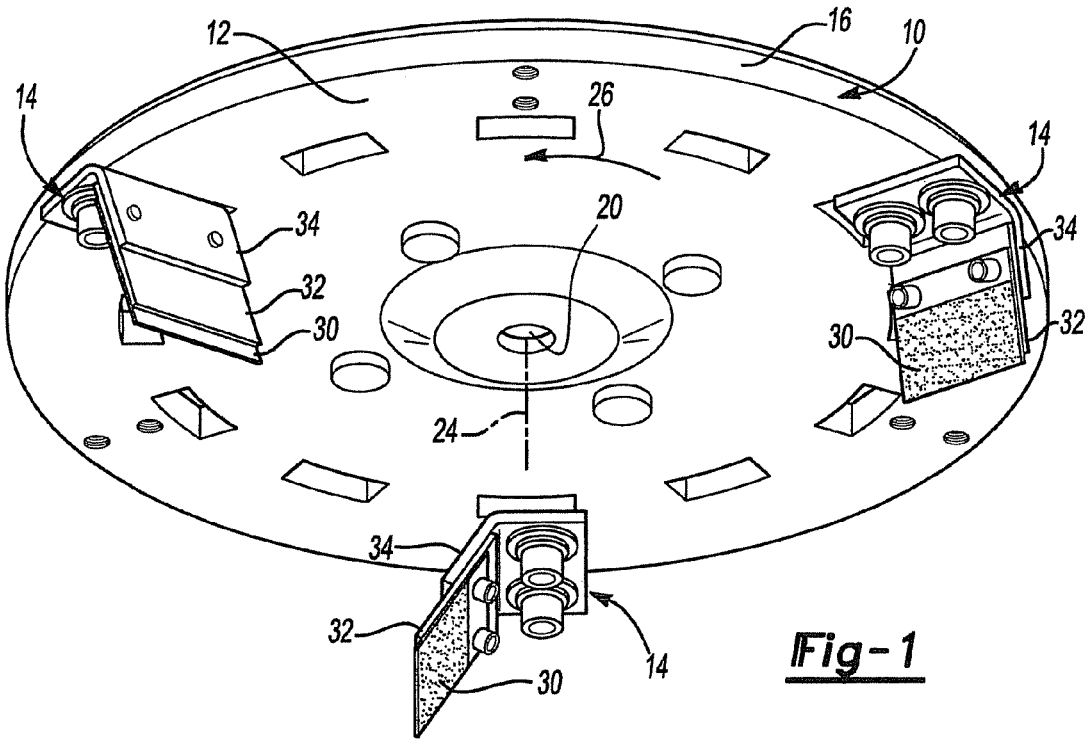
FIG. 1 is a bottom perspective view of an abrasive pad incorporating one embodiment of the invention.
Figure 2:
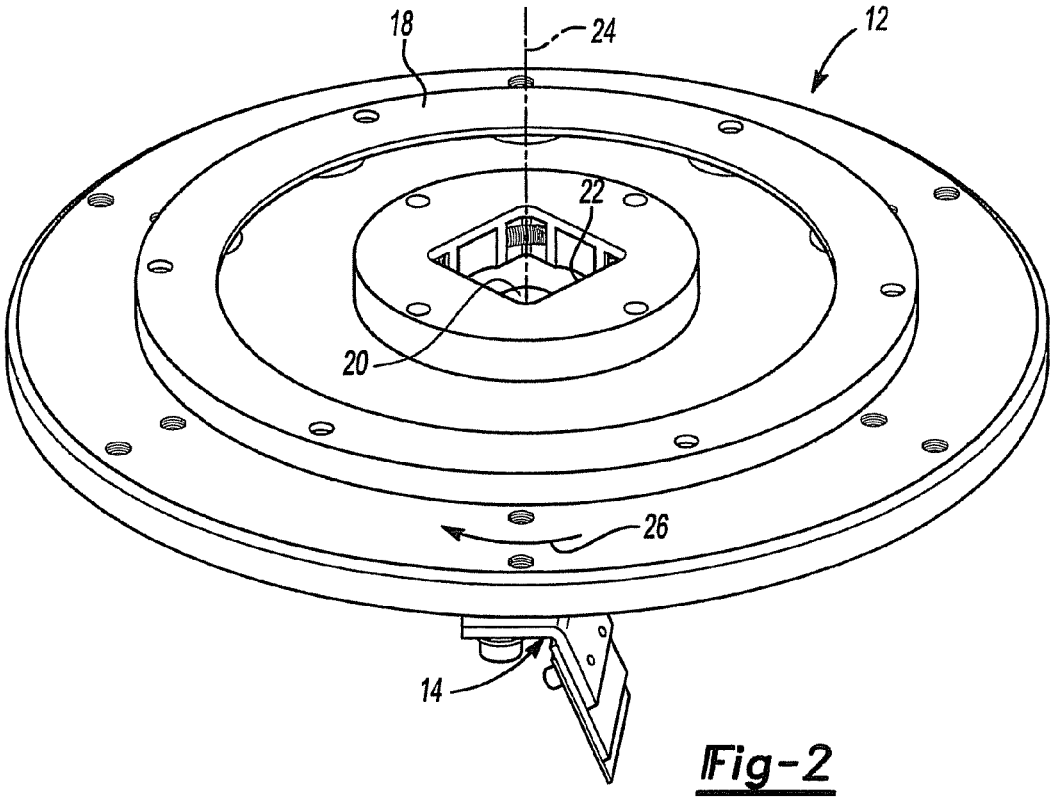
FIG. 2 is a top perspective view of the pad shown in FIG. 1.

Referring now to FIG. 1, a rotatable abrasive preparation device 10 includes a housing, for example in the form of a pad or disc 12 as illustrated that has a plurality of abrasive element assemblies 14 circumferentially mounted near the periphery 16 of disc 12. The rotatable disc 12 as shown in FIG. 2 has a mounting aperture 20 in its upper face 18 and conventional snap lock 22 for operably connecting to a drive spindle of a conventionally powered abrading machine for example, a cleaning machine, buffing machine, or sanding machine. The disc 12 is constructed to normally rotate about its center axis 24 in a direction as indicated by arrow 26.

Figure 3:
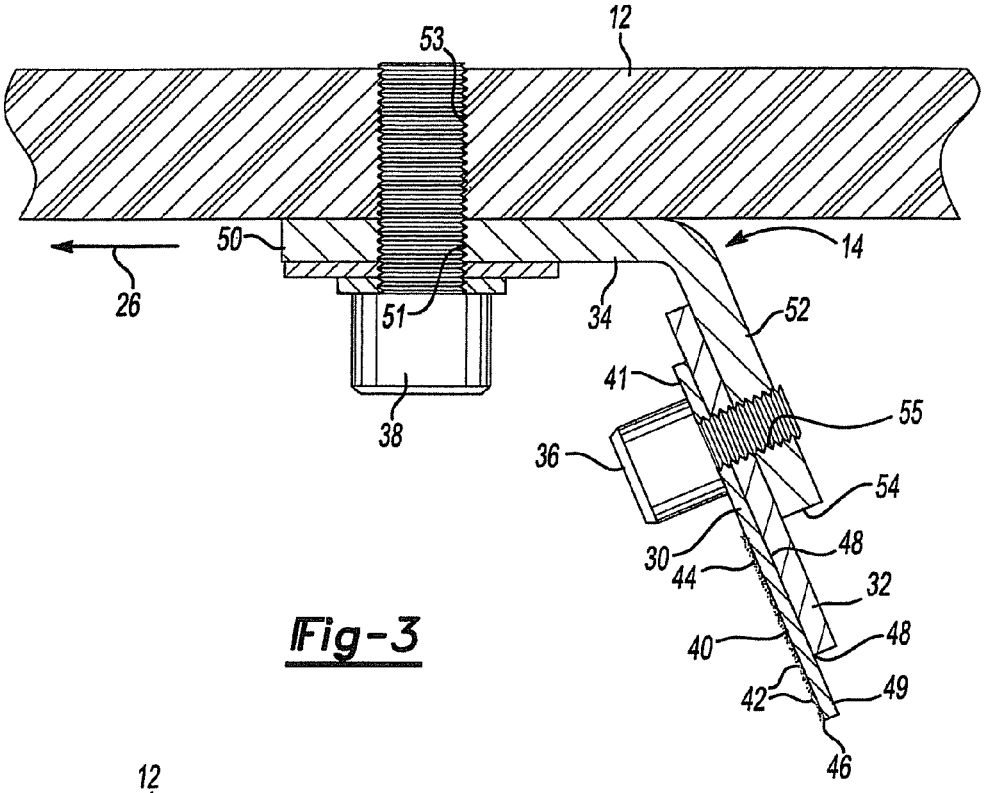
FIG. 3 is an enlarged side elevational view illustrating one abrasion element assembly shown in FIG. 1.
Figure 4:
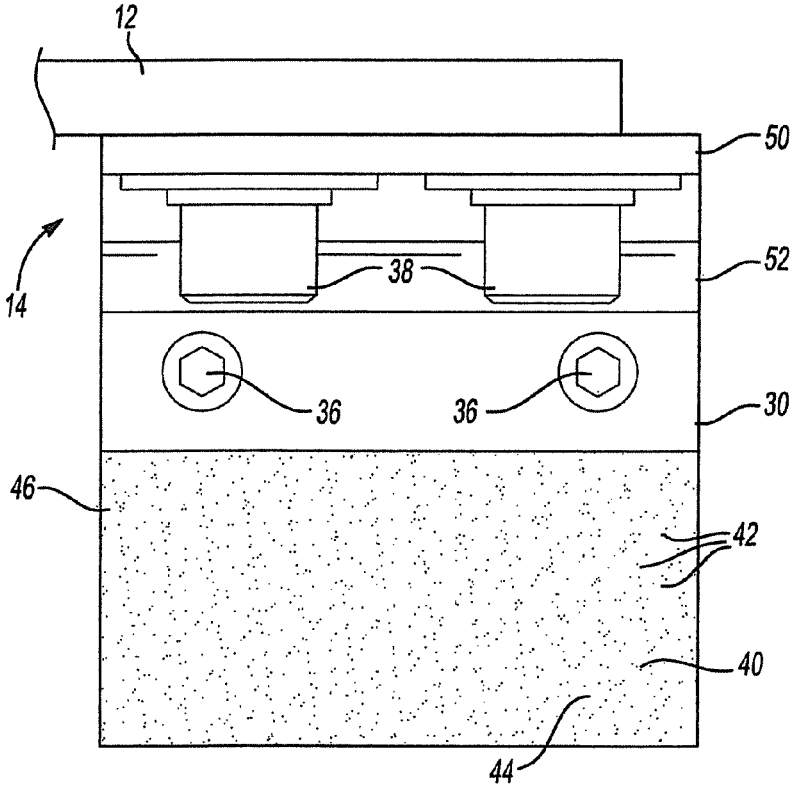
FIG. 4 is an enlarge front elevational view of the abrasion element assembly shown in FIG. 3.

Each abrasive element assembly 14, as more clearly shown in FIGS. 3 to 6, has a substrate layer 30, support layer 32 and mounting bracket 34 assembled together via threaded fasteners 36 and secured to the disc 12 via threaded fasteners 38. The substrate layer 30 as shown in FIG. 4 has a distal section 40 coated with abrasive particles 42 only at the front surface 44, for example diamond particles that are brazed onto the substrate layer 30 with a brazing, material 46. The proximate mounting section 41 and the rear surface 48 of substrate layer 30 are substantially devoid of diamond particles 42 and brazing material 46. The substrate layer 30 may be a piece of strapping steel or other low carbon steel to which the brazing material 46 affixes the diamond particles 42. The substrate layer can also be any other metal or a high temperature plastic depending on the particular application.

The brazing material 46 may be Nicro Braze LM or other commercially available brazing material. The diamond particles 42 may also be plated onto the substrate layer 30. The grit size of the diamond particles may be widely varied. It is foreseen that particle sizes of about 5 mesh to 500 mesh or even finer particles sizes can be used. It is preferred that the diamond particles 42 are a blend of different mesh size particles ranging from the 5 mesh size to the 120 mesh size with a great weight percentage of the diamond particles being varied between 16 mesh (1.2 mm) and 120 mesh (110 microns).

Figure 5:
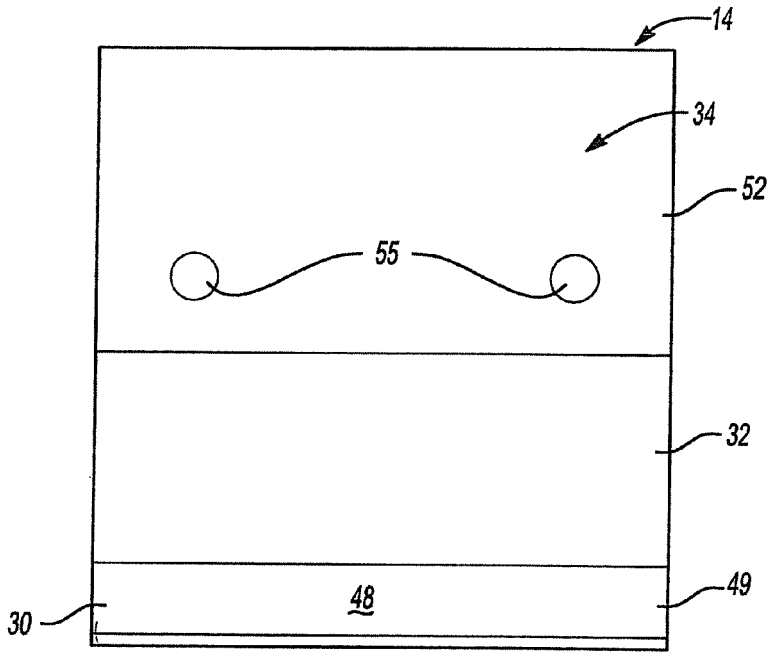
FIG. 5 is an enlarged rear elevational view of the abrasion element assembly shown in FIG. 3.
Figure 6:
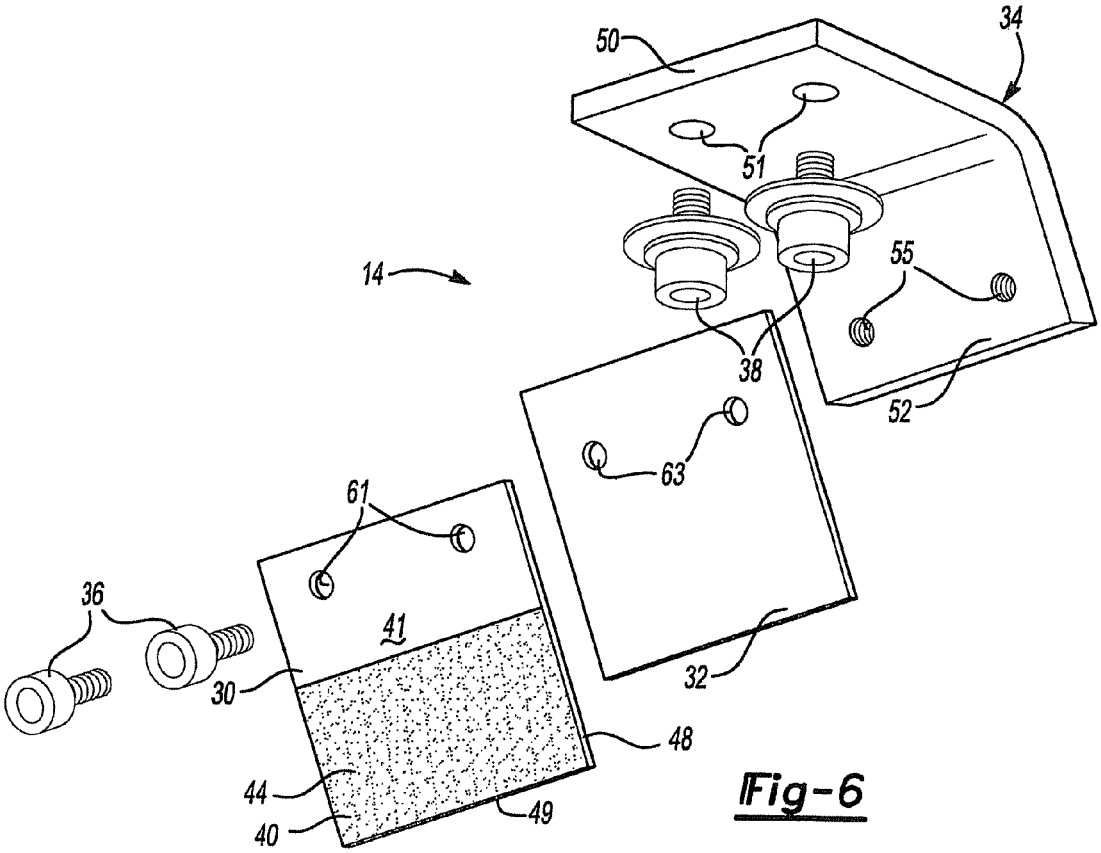
FIG. 6 is a side exploded view of the abrasion element assembly shown in FIG. 3.

The backing layer 32 is in abutting relationship to the rear surface 48 of substrate layer 30. The backing layer 32 can be made from any wear resistant material such as metal or a high temperature polymer but a resilient spring quality metal such as spring steel is preferred. The spring steel layer 32 is not brazed in order to retain its spring and resilient ductile quality. The spring steel backing layer 32 abuts a substantial portion of the rear surface 48 of substrate layer 30 as shown in FIGS. 3 and 5 and provides reinforcement support to the substrate layer 30. In some applications, a distal end section 60 of substrate layer 30 may extend beyond the end 62 of backing layer 32, to provide operating edge 49 beyond end 62. In other applications it may be preferred that distal section 60 does not extend beyond end 62 so that edge 49 is flush with the distal end 62 of the backing layer 32.

The substrate layer 30 and backing layer 32 may be affixed to bracket 34. The bracket 34 has an upper section 50 that seats flush against the disc 12. The bracket 34 upper section can be mounted via threaded fasteners 38 that pass through apertures 51 therein and engage threaded apertures 53 in the disc 12. The bracket 34 also has a depending canted section 52. The cant is set at an angle to the perpendicular for example between 5 degrees and 75 degrees, but preferably between 25° and 60° with its distal end 54 trailing with respect to the direction of motion of disc 12. Threaded fasteners 36 extend through apertures 61 and 63 in both layers 30 and 32 and engage threaded apertures 55 in bracket 34 to securely clamp the two layers 30 and 32 together and secure them to the depending canted section 52 such that the layers 30 and 32 extend along the same canted angle of bracket section 52.

The substrate layer 30 has its front surface 44 facing generally forward relative to the normal operating motion of the pad 12. As shown, the front surface 44, may be aligned with the radial center of the pad and its radial extending width is substantially transverse to the normal rotating motion of the pad. However, it should also be understood that the radial extending width can be set at other angles relative to the radial direction as long as the front surface 44 faces generally forward to operably expose the diamond particles 42.

Figure 7:
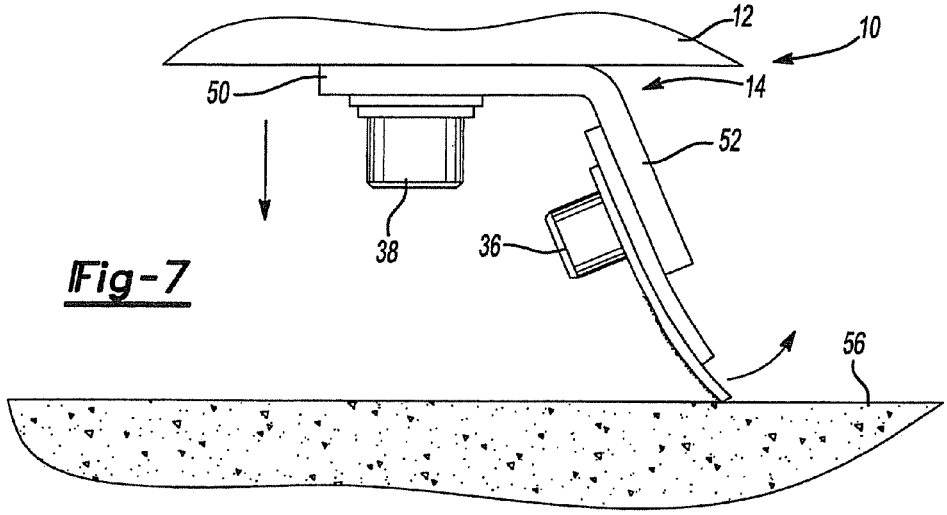
FIG. 7 is a view similar to FIG. 3 illustrating the abrasion element assembly in a working and flexed position on a concrete surface.

The lengths i.e. heights of the layers 30 and 32 are generally substantially greater than the thickness of the layers 30 and 32 to allow flexibility of the layers 30 and 32 during certain sanding applications. A typical flex during certain sanding operation is schematically shown in FIG. 7 where the flex further increases the angle at which the front surface 44 engages the working floor surface 56. In other applications, the support backing element 32 and the bracket 34 may be dimensioned to reduce or substantially eliminate the flex depending on the application The width of the layers 30 and 32 as shown in the figures may be greater than its length so that each abrasive element assembly 14 resembles a blade. The relatively large width provides for greater structural integrity and decreases the number of individual assemblies 14 needed to be mounted onto the disc. However, the width can be substantially changed so that the assemblies 14 can appear to resemble more of a strip, needle, or bristle rather than a blade.

Figure 8:
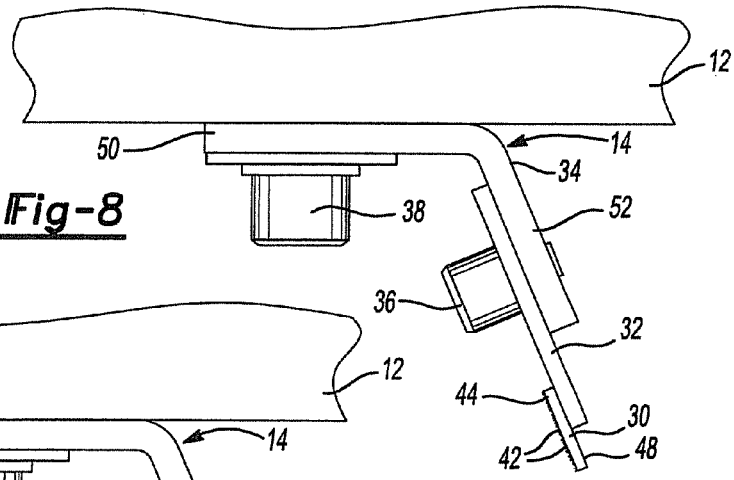
FIG. 8 is a method of attaching the bristle shown in FIG. 7 to a side elevational view illustrating a second embodiment of an abrasion element assembly.

FIG. 8 illustrates a modified embodiment where the substrate layer 30 is adhesively secured to the backing layer 32 and does not extend up to fasteners 36. Fasteners 36 clamp only backing layer 32 to the bracket 34. The substrate layer by being shortened may have its entire front surface 44 brazed with brazing material 46 to secure diamond particles thereon. The rear surface 48 remains devoid of particles 42 and brazing material 46.

Figure 9:
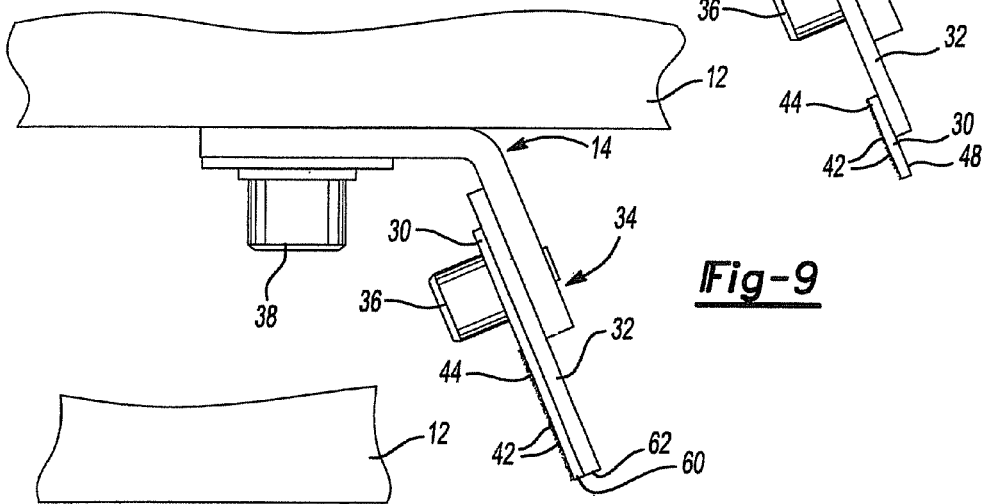
FIG. 9 is a side elevational view illustrating a third embodiment of an abrasion element assembly.

FIG. 9 illustrates a third embodiment where the substrate layer 30 and backing layer 32 both have a distal end 60 and 62 ending at the same point such that edge 49 does not initially extend beyond the backing layer 32.

Figure 10:
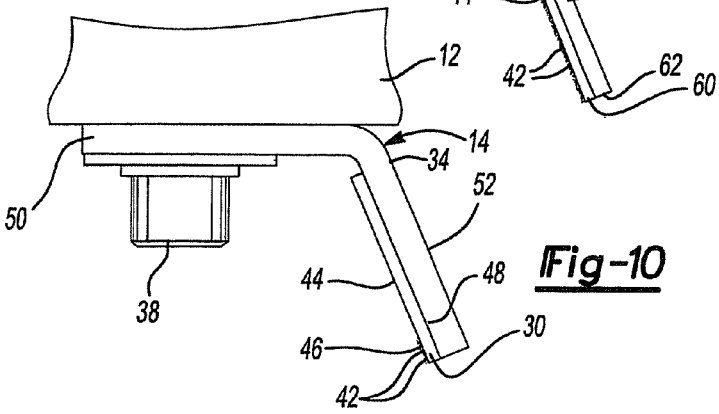
FIG. 10 is a side elevational view illustrating a fourth embodiment of an abrasion element assembly.

FIG. 10 illustrates a fourth embodiment where the substrate layer 30 is adheredly bonded directly to the distal leg 52 of the bracket 34. In this embodiment the leg 52 is dimensional to act and function as the support backing layer 32 shown in other embodiments. The bracket 34 is made of spring steel and its thickness and length are both dimensioned to provide the desired amount of resilient flex and backing support to substrate layer 30.

It has been found that the construction of the invention provides for superior and more efficient performance than previous diamond or hard particle brushes. The weight and horsepower needed to effectively abrade with this improved abrasive device are substantially reduced such that the device 10 can be used on a consumer oriented cleaning or sanding machine rather than heavier more powerful industrial power machine.

Furthermore, the diamond particles by being brazed onto the substrate layer with the appropriate brazing material are sacrificial. In other words, the diamonds will wear off the brazed area before they become overly worn and rounded to expose other diamond particles with fresh sharp edges. Thus the performance profile of the abrasion element remains high until the entire distal section with the diamond is worn away. The sacrificing of the diamonds prevents what can be termed a ball bearing effect. If the diamonds stay on too long, they become rounded and lose their cutting edge. If the worn diamond particles remain on the substrate layer, only these worn round points remain in contact with the cement working surface and the rounded points merely glide over the surface without any effective cutting. They start to act more like a ball bearing rather than cutting edges with a resulting dramatic decrease of performance. The sacrificial nature of the diamonds prevents this decrease and maintains the performance level at or near when the abrasive element assembly is newly manufactured.

Furthermore, the speed at which the abrasion occurs renders sufficient concrete dust as the assembly cuts into both the concrete surface and any top coating such that the top coating as it melts is instantly covered with the dust to provide a dryer outer surface which prevents the melted paint, mastic or plastic from undesirably sticking to the abrasion element assembly. Conventional wisdom states one must slow down the aggression by slowing the machine down to prevent higher heat and melting of the plastic, mastic or paint coatings. However, a more aggressive cut through the melted plastic, paint, or mastic along with the concrete to provide a dust coating prevents the melted coatings from adhering to the abrasive element assembly.

Fasteners 36 and 38 provide an expeditious way to removably secure the operating parts 30, 32 and 34 to the disc 12. When the parts 30, 32 and 34 need replacing, the parts can be easily removed and replaced as needed. It is foreseen however that other fasteners other than that shown may be used. It is further foreseen that the abrasive element assembly 14 may be replaceable cartridge that may be secured as a whole to the disc 12 via a slot or bayonet fitting.

In this fashion an abrasion device with as few as two or three abrasion element assemblies circumferentially spaced at the bottom of the disc pad in proximity to its periphery can provide for an efficient abrading device for preparation of a cement floor before applying a new coat thereon.

Other variations and modifications are possible without departing from the scope and spirit of the present invention as defined by the appended claims.

What is claimed is:

1. An abrasive hard surface preparation device for use with a rotary device, the abrasive hard surface preparation device comprising:

a rotatable housing;

at least one substrate layer having a first end connected to the housing and an opposite second end, the at least one substrate layer including a first substrate layer and a second substrate layer arranged adjacent the first substrate layer with no intermediate substrate layer disposed between the first and second substrate layers; and an abrasive material attached to at least the second end of the at least one substrate layer, at least a portion of the at least one substrate layer adjacent the abrasive material being positioned obliquely with respect to the housing, and the first and second substrate layers being separated from one another such that the abrasive material attached to the first and second substrate layers does not contact any portion of the adjacent substrate layer.

2. The abrasive hard surface preparation device of claim 1, wherein the first and second substrate layers deflect from a first position to a second position when a load is applied to the second end of the substrate layer, the first and second substrate layers being separated from one another such that one of the substrate layers does not contact the other substrate layer when at least one of the substrate layers is arranged in the second position.

3. The abrasive hard surface preparation device of claim 2, wherein at least a portion of the substrate layer adjacent the abrasive material is positioned obliquely with respect to the housing when the substrate layer is arranged in the second position.

4. The abrasive hard surface preparation device of claim 2, wherein the first and second substrate layers substantially return to the first position when the load is removed.

5. The abrasive hard surface preparation device of claim 1, wherein at least a portion of the substrate layer adjacent the abrasive material is substantially planar.

6. The abrasive hard surface preparation device of claim 5, wherein the first and second substrate layers deflect from the substantially planar configuration to a curved configuration when a load is applied to the second end of the substrate layer, the first and second substrate layers being separated from one another such that one of the substrate layers does not contact the other substrate layer when one of the substrate layers is arranged in the curved configuration.

7. The abrasive hard surface preparation device of claim 5, wherein the substrate layer deflects from the substantially planar configuration to a curved configuration when a load is applied to the second end of the substrate layer, and substantially returns to the substantially planar configuration when the load is removed.

8. The abrasive hard surface preparation device of claim 1, wherein the entire substrate layer is displaced away from the housing.

9. The abrasive hard surface preparation device of claim 1, wherein the substrate layer includes a first region arranged adjacent the housing and a second region to which the abrasive material is attached, the first region disposed between the second region and the housing and devoid of abrasive material.

10. The abrasive hard surface preparation device of claim 1, wherein the substrate layer comprises a resilient material.

11. The abrasive hard surface preparation device of claim 1, further comprising a backing layer arranged adjacent the substrate layer, wherein the substrate layer is disposed between the abrasive material and the backing layer.

12. The abrasive hard surface preparation device of claim 11, wherein the backing layer includes a proximal end arranged adjacent the housing and an opposite distal end, wherein the substrate layer extends beyond the distal end of the backing layer.

13. The abrasive hard surface preparation device of claim 11, wherein the substrate layer engages the backing layer, the abrasive hard surface preparation device further comprising at least one fastener securing the substrate layer to the backing layer.

14. The abrasive hard surface preparation device of claim 11, wherein the substrate layer is bonded to the backing layer.

* * * * *